United States Patent [19]

Tai

[11] 4,126,572

[45] Nov. 21, 1978

[54] BUILT LIQUID DETERGENT COMPOSITION

[75] Inventor: Ho Tan Tai, Santes, France

[73] Assignee: Lever Brothers Company, New York, N.Y.

[21] Appl. No.: 773,863

[22] Filed: Mar. 3, 1977

[30] Foreign Application Priority Data

Mar. 11, 1976 [GB] United Kingdom ..... 9802/76

[51] Int. Cl.[2] ..... C11D 1/83

[52] U.S. Cl. ..... 252/89 R; 252/DIG. 1; 252/109; 252/173; 252/540; 252/DIG. 14; 260/502.4 R

[58] Field of Search ..... 252/DIG. 1, 89, 540, 252/173, 109, 107, 108, 363.5, DIG. 14; 260/502.4 R, 501.12

[56] References Cited

U.S. PATENT DOCUMENTS

| | | | |
|---|---|---|---|
| 2,397,422 | 3/1946 | Kosolapoff | 260/502.4 R |
| 3,122,508 | 2/1964 | Grifo | 252/DIG. 1 |
| 3,156,655 | 11/1964 | Bright | 252/109 |
| 3,630,934 | 12/1971 | Kelly | 252/89 |
| 4,021,376 | 5/1977 | Lamberti | 252/173 |

*Primary Examiner*—George F. Lesmes
*Assistant Examiner*—E. Rollin Buffalow

[57] ABSTRACT

A critical mixture of a sulphonate-type hydrotrope and a monoalkane phosphonic acid or salt thereof when included in an aqueous built liquid detergent provides for an improved stability, clarity and homogeneity thereof.

3 Claims, No Drawings

BUILT LIQUID DETERGENT COMPOSITION

BACKGROUND OF THE INVENTION

1. Field of the Invention

The present invention relates to an aqueous built liquid detergent composition. More particularly it relates to an improvement in the storage stability of aqueous built liquid detergent compositions, obtained by the inclusion of a particular hydrotrope system therein.

2. Description of the Prior Art

It is well known that aqueous built liquid detergent compositions may suffer from storage instability leading to phase-separation, both at room temperature and at temperatures below 0° C., if no proper precautions have been taken. Furthermore, aqueous built liquid detergent compositions are normally required to be homogeneous, clear liquids, which also demands special precautions.

One of the common practices to achieve stable, homogeneous, clear liquids is to incorporate hydrotropes in aqueous built liquid detergent compositions, which solubilize particular ingredients in the liquid compositions. Commonly employed for said purpose are hydrotropes such as urea, ethyl-alcohol, toluene-, cumene- and xylene sulphonates. However, whereas such hydrotropes may give the desired effects, the amount required may be rather high, or, with particular aqueous built liquid detergent compositions, they may not produce the required degree of homogeneity, clarity and storage stability.

SUMMARY OF THE INVENTION

It has now been found that a hydrotrope system comprising a sulphonate-type hydrotrope of the general formula

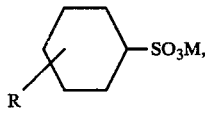

in which R is a methyl, dimethyl or isopropyl residue and M=H, $NH_4$, substituted $NH_4$, or an alkali metal, such as sodium or potassium, and an alkane phosphonic acid of the general formula

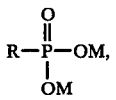

in which R is a saturated alkyl residue with 4–10 carbon atoms, and M is H, $NH_4$, substituted $NH_4$ or an alkali metal such as sodium or potassium, significantly improves the homogeneity, clarity and storage stability of built aqueous liquid detergents.

DESCRIPTION OF THE PREFERRED EMBODIMENTS

In comparison with the sulphonate-type hydrotropes alone, the combination enables a significant reduction of the amount of sulphonate-type hydrotrope used, while simultaneously improving the overall hydrotrope effect, and vice versa with regard to the alkane-phosphonic acid alone.

The sulphonate-type hydrotropes are toluene-, xylene- and cumene sulphonates, preferably in the form of the sodium salts, although potassium, ammonium and substituted ammonium salts may also be used if desired. Particularly preferred are sodium toluene- and xylene sulphonate.

The other hydrotrope is a monoalkane phosphonic acid, in which the alkane residue may be branched-, but is preferably straight-chained, and contains from 4–10 carbon atoms. It may be used in the acid form, or in the form of the mono- or dialkali metal metal such as sodium or potassium, ammonium and substituted ammonium salt. Particularly preferred is monooctane phosphonic acid.

The amount of the sulphonate-type hydrotrope used in the present invention is from 0.75–8.5% by weight of the composition, and the amount of monoalkane phosphonic acid is from 0.5–2.5%, preferably 1–2% by weight of the composition, with the proviso that in the case of sodium xylene sulphonate more than 4% thereof should be used if the amount of monoalkane phosphonic acid is 1% or less. The hydrotrope system provides for better stability, clarity and homogeneity when included in aqueous built liquid detergent compositions, i.e. compositions containing an active synthetic detergent composition and an inorganic builder salt. Such builder salts include the sodium or potassium ortho-, pyro- and polyphosphates, and sodium or potassium carbonates, and mixtures thereof.

The benefit of the invention is particularly achieved in aqueous liquid detergent compositions which contain alkali metal carbonates such as sodium or potassium carbonate as the builder salt. The amount of the inorganic builder salt present in such liquids may vary from 1–25% by weight, and preferably lies between 5 and 15% by weight.

In carbonate-built liquid detergents it is useful to include a polyelectrolyte to prevent undesired incrustation or soil redeposition. Such polyelectrolytes are e.g. polyacrylates, copolymers or ethylene with maleic anhydride or copolymers of maleic anhydride with vinylmethylether. Particularly preferred are polyacrylic acids with a molecular weight of between 3,500–22,000. The amount of polyelectrolyte used varies from 0.5–5%, preferably from 1–3% by weight.

Although the liquid detergent compositions may comprise a simple synthetic detergent active such as an alkylaryl sulphonate with 10–24 carbon atoms in the alkyl chain, an alkane sulphonate with 10–24 carbon atoms in the alkane chain, alkylether sulphates with 10–24 carbon atoms in the alkyl chain and from 1–10 moles of an alkylene oxide such as ethylene oxide and/or propylene oxide, nonionic synthetic detergents i.e. adducts of 5–30 moles of an alkylene oxide to a $C_{10}$–$C_{24}$ primary or secondary alcohol, to a $C_9$–$C_{18}$ alkylphenol, soaps, amphoteric surfactants etc, it has been found that the benefits of the invention are particularly obtained in an aqueous built liquid detergent composition which comprises a ternary system of detergent active materials, i.e. an anionic + a nonionic + a soap. The anionic synthetic detergent is a $C_{10}$–$C_{24}$ alkylbenzene sulphonate (as alkali metal, e.g. sodium or potassium, ammonium or substituted ammonium salt), the nonionic is an ethoxylated linear $C_8$–$C_{22}$ alcohol condensed with 3 to 25 moles of ethylene oxide and the soap is a sodium or potassium, ammonium or substituted ammonium salt of a polymeric fatty acid, predominantly consisting of dimerized oleic acid. The amounts of the anionic, nonionic and soap may vary from 5–15, 1–5 and 1–5% respectively. Other anionics, nonionics and soaps, including soaps of $C_{10}$–$C_{24}$ fatty acids may also be used instead of the above-identified ones.

The compositions may furthermore comprise the usual ingredients such as silicates, borates, phosphates, fluorescers, soil-suspending agents, lather controllers or lather boosters, perfumes, germicides, enzymes, opacifiers, anti-redeposition agents, and so on.

The invention will now be further illustrated by the following Examples.

EXAMPLE I

A liquid detergent formulation was prepared from the following ingredients

| | % by weight |
|---|---|
| dodecylbenzene sulphonic acid | 6.5 |
| dimerized oleic acid | 5 |
| $C_{13}$–$C_{15}$ primary alcohol, condensed with 11 moles of ethylene oxide | 2.7 |
| polyacrylic acid (MW 3,500–5,000) | 2.0 |
| SCMC (low viscosity) | 0.15 |
| sodium silicate | 11 |
| potassium hydroxide | 3 |
| potassium carbonate | 7 |
| sodium xylene sulphonate (40.7% active) | x |
| monooctane phosphonic acid (100% active) | y |
| water | q.s.100. |

First a premix of the potassium hydroxide, the dodecylbenzene sulphonic acid, the dimerized oleic acid, and the $C_{13}$–$C_{15}$ primary alcohol condensed with 11 moles of ethylene oxide was prepared, to which subsequently the remaining ingredients were added under agitation, and without heating. The amount of sodium xylene sulphonate ($x$) and monooctane phosphonic acid ($y$) were varied in a series of experiments, and the physical characteristics of the liquids obtained were assessed. The following results were obtained:

| Storage temperature: room temperature | | | |
|---|---|---|---|
| % monooctane phosphonic acid = y | 1 | 2 | 3 |
| % sodium xylene sulphonate = x | 0 | 0 | 0 |
| Physical characteristics of liquid detergent composition | 2 liquid phases | 1 liquid and 1 solid phase | 1 liquid and 1 solid phase |

| Storage temperature: A: room temperature B: −4° C | | | | | | |
|---|---|---|---|---|---|---|
| % sodium xylene sulphonate (40.7% active material) = x | 12 | 14 | 16 | 18 | 20 | 22 |
| % monooctane phosphonic acid = y | 0 | 0 | 0 | 0 | 0 | 0 |
| Physical characteristics of liquid detergent composition | A | two liquid phases | | homogeneous clear liquid | | |
| " B | two liquid phases | | homogeneous clear liquid | crystal formation | | |

| Storage temperature: A: room temperature B: −4° C | | | | | |
|---|---|---|---|---|---|
| % sodium xylene sulphonate (40.7% active material = x | 7 | 8 | 10 | 12 | 14 |

-continued

| Storage temperature: A: room temperature B: −4° C | | | | | |
|---|---|---|---|---|---|
| % monooctane phosphonic acid = y | 1 | 1 | 1 | 1 | 1 |
| Physical characteristics of liquid detergent composition | A two liquid phases | | clear, homogeneous liquid | | |
| " | B | | " | " | |

This example shows that monooctane phosphonic acid alone did not produce a clear, homogeneous liquid, and that only with 18–20% sodium xylene sulphonate (40.7% active material) alone a clear, homogeneous liquid both at room temperature and at −4° C. could be obtained. The combination of these two hydrotropes with e.g. 10% of sodium xylene sulphonate (40.7% active material) and 1% monooctane phosphonic acid produced already a clear, homogeneous liquid, i.e. a reduction of the sodium xylene sulphonate by almost 50% could be obtained.

EXAMPLE II

In the same manner as in Example I the following composition was prepared.

| | % by weight |
|---|---|
| dodecylbenzene sulphonic acid | 7 |
| $C_{13}$–$C_{15}$ primary alcohol, condensed with 11 moles of ethylene oxide | 2.5 |
| dimerized oleic acid | 3.5 |
| potassium hydroxide | 3.3 |
| potassium carbonate | 10 |
| alkaline silicate | 4.4 |
| polyacrylic acid (M.W. 3,500–5,000) | 2 |
| SCMS (low viscosity) | 0.15 |
| fluorescers | 0.15 |
| sodium xylene sulphonate (SXS) (100% active) | x |
| monooctane phosphonic acid (MOP) (100% active) | y |
| colouring agent, perfume and water q.s. | 100 |

The following storage stabilities were assessed:

| storage temp. | hydrotrope | 6% SXS 1% MOP | 4% SXS 2% MOP |
|---|---|---|---|
| 37° C | | clear liquid | clear liquid |
| 20° C | | " | " |
| −4° C | | " | " |

EXAMPLE III

Replacing potassium carbonate by sodium carbonate in Example I produces similar results, as does replacing sodium xylene sulphonate by sodium toluene- or cumene sulphonate.

EXAMPLE IV

The following two built liquid detergents were prepared:

| | % by weight | |
|---|---|---|
| | A | B |
| potassium dodecylbenzene sulphonic acid | 6.4 | 7.2 |
| dimerized oleic acid | 5.67 | 5.9 |
| $C_{13}$–$C_{15}$ primary alcohol, condensed with 11 moles of ethylene oxide | 2.65 | 0.77 |
| $C_{16}$–$C_{20}$ linear primary alcohol, condensed with 25 moles of ethylene oxide | — | 1.35 |
| sodium tripolyphosphate | — | 11.65 |
| potassium carbonate | 7.0 | 3.9 |
| potassium orthophosphate | — | 1.95 |
| sodium silicate ($SiO_2$:$Na_2O$ = 2) | 4.3 | 2.9 |

-continued

| | % by weight | |
|---|---|---|
| | A | B |
| potassium hydroxide (to neutralize the dimerized oleic acid) | 1.8 | 0.7 |
| sodium xylene sulphonate (40.7% active) | x | x |
| sodium toluene sulphonate (45% active) | y | y |
| monooctance phosphonic acid (100% active) | z | z |
| potassium polyacrylate | 2.0 | 0.49 |
| sodium carboxymethylcellulose | 0.15 | — |
| water | q.s. | q.s. |

Varying amounts of $x$, $y$ and $z$ were used ($x$ = 0–30%, $y$ = 0–30%, $z$ = 0–3%), and the liquids were stored at room temperature, and at changing temperatures (−4° C. and room temperature) 5 times, each for 48 hours. The products were assessed for clarity, homogeneity and stability, they being found satisfactory if the liquid was clear and homogeneous, or, in the case of the changing temperatures, if there were crystals which rapidly dissolved again or when there was only a temporary cloudiness.

The following results were obtained:

| | |
|---|---|
| Liquid A was satisfactory when | x = 10–20%<br>z = 1%<br>or y = 2–10%<br>z = 2% |
| Liquid B was satisfactory when | x = 12–14%<br>z = 1%<br>or x = 2–10%<br>z = 2%<br>or y = 10–12%<br>z = 1%<br>or y = 2–6%<br>z = 2%. |

In all other cases, using $x$ or $y$ or $z$ alone much more was needed to obtain satisfactory liquids, e.g. for liquid A either $x$ = 22–30% or $z$ = 3% was needed, and with $y$ alone no clear liquid was obtained at all. For liquid B, neither $x$ alone nor $y$ alone nor $z$ alone produced a clear liquid.

I claim:

1. An aqueous built liquid detergent composition, consisting essentially of:

(a) 5–15% by weight of an anionic synthetic detergent selected from the group consisting of $C_{10}$–$C_{24}$ alkylbenzene sulphonates, $C_{10}$–$C_{24}$ alkane sulphonates and $C_{10}$–$C_{24}$ alkylether sulphates containing 1–10 moles of ethylene- or propylene oxide;

(b) 1–5% by weight of a nonionic synthetic detergent selected from a group consisting of adducts of 5–30 moles of an alkylene oxide to $C_{10}$–$C_{24}$ primary alcohols, $C_{10}$–$C_{24}$ secondary alcohols, and $C_9$–$C_{18}$ alkylphenols;

(c) 1–5% by weight of a sodium or potassium salt of dimerized oleic acid;

(d) 1–25% by weight of a sodium or potassium builder salt selected from the group consisting of orthophosphates, pyrophosphates, tripolyphosphates, carbonates and mixtures thereof;

(e) 0.75–8.5% by weight of an alkali metal or ammonium salt of xylene-, toluene- or cumene sulphonic acid;

(f) 0.5–2.5% by weight of a monoalkane phosphonic acid, in which the alkane group contains 4–10 carbon atoms, or the alkali metal or ammonium salt thereof, whereby the amount of salt of xylene sulphonic acid is more than 4% by weight when the amount of the monoalkane phosphonic acid is 1% or less.

2. A composition according to claim 1, further comprising 0.5–5% by weight of a sodium or potassium polyacrylate with a molecular weight of 3,500–22,000.

3. A composition according to claim 1, wherein the monoalkane phosphonic acid is monooctane phosphonic acid.

* * * * *